US010619431B2

(12) United States Patent
Vestersjo et al.

(10) Patent No.: US 10,619,431 B2
(45) Date of Patent: Apr. 14, 2020

(54) TUBULAR STABBING GUIDE

(71) Applicants: WEATHERFORD U.K. LIMITED, Leicestershire (GB); WEATHERFORD NORGE AS, Sandnes (NO)

(72) Inventors: Svein Egil Vestersjo, Sandnes (NO); Scott Sivewright, Aberdeen (GB); Ian Killoh, Aberdeen (GB); Kristian Osmumdsen, Sandnes (NO)

(73) Assignees: Weatherford U.K. Limited (GB); Weatherford Norge AS (NO)

( * ) Notice: Subject to any disclaimer, the term of this patent is extended or adjusted under 35 U.S.C. 154(b) by 310 days.

(21) Appl. No.: 14/910,795

(22) PCT Filed: Aug. 11, 2014

(86) PCT No.: PCT/GB2014/052453
§ 371 (c)(1),
(2) Date: Feb. 8, 2016

(87) PCT Pub. No.: WO2015/019117
PCT Pub. Date: Feb. 12, 2015

(65) Prior Publication Data

US 2016/0186510 A1 Jun. 30, 2016

(30) Foreign Application Priority Data

Aug. 9, 2013 (GB) ..... 1314323.5

(51) Int. Cl.
*E21B 19/24* (2006.01)
*E21B 19/00* (2006.01)
(Continued)

(52) U.S. Cl.
CPC ..... *E21B 19/24* (2013.01); *E21B 19/00* (2013.01); *E21B 19/16* (2013.01); *E21B 29/007* (2013.01); *E21B 33/085* (2013.01); *E21B 41/00* (2013.01)

(58) Field of Classification Search
CPC ..... E21B 19/24; E21B 33/085; E21B 29/007; E21B 41/00; E21B 19/16; E21B 19/00
See application file for complete search history.

(56) References Cited

U.S. PATENT DOCUMENTS 1,945,876 A * 2/1934 Young
3,206,259 A * 9/1965 Curtis ..... E21B 19/24 384/24

(Continued)

FOREIGN PATENT DOCUMENTS

GB 2345073 6/2000
GB 2420362 5/2006

(Continued)

OTHER PUBLICATIONS

Further Search Report under Section 17 for GB Patent Application No. 1314323.5; dated Jun. 9, 2014; pp. 1-3.

(Continued)

*Primary Examiner* — Blake E Michener
(74) *Attorney, Agent, or Firm* — Blank Rome, LLP

(57) ABSTRACT

A tubular stabbing guide (10) used to assist in the location of a pin end connection of a tubular in a box end connection (14) of another tubular forming the upper end of a drill string held and supported from the drill floor (16) of a rig. The stabbing guide (10) has a mounting frame (22) for location on the drill floor (16) and funnel-forming members (32) mounted on the frame (22). In use, the funnel-forming members (32) are moved from a retracted location spaced from the box end connection (14) to an active location surrounding the box end connection (14), such that the (Continued)

funnel-forming members (32) form a funnel for guiding the pin end connection into the box end connection (14).

21 Claims, 7 Drawing Sheets

(51) Int. Cl.

| | |
|---|---|
| ***E21B 19/16*** | (2006.01) |
| ***E21B 41/00*** | (2006.01) |
| ***E21B 29/00*** | (2006.01) |
| ***E21B 33/08*** | (2006.01) |

(56) References Cited

U.S. PATENT DOCUMENTS

| | | | | |
|---|---|---|---|---|
| 3,475,038 | A * | 10/1969 | Matherne | |
| 3,576,062 | A * | 4/1971 | Matherne | |
| 3,603,387 | A | 9/1971 | Shoeffler | |
| 4,690,213 | A | 9/1987 | Stannard et al. | |
| 5,597,041 | A | 1/1997 | Robinson | |
| 6,748,823 | B2 * | 6/2004 | Pietras | E21B 19/16 81/57.33 |
| 7,090,254 | B1 | 8/2006 | Pietras et al. | |
| 7,114,235 | B2 * | 10/2006 | Jansch | |
| 7,832,487 | B2 * | 11/2010 | Jensen | |
| 8,905,150 | B1 * | 12/2014 | Pruitt | |
| 2004/0049905 | A1 * | 3/2004 | Jansch | |
| 2008/0296016 | A1 * | 12/2008 | Hughes | |
| 2009/0056930 | A1 * | 3/2009 | Angelle | |
| 2012/0168227 | A1 | 7/2012 | Littlely et al. | |
| 2012/0247770 | A1 * | 10/2012 | Roane | |
| 2015/0354297 | A1 * | 12/2015 | Arp | |

FOREIGN PATENT DOCUMENTS

| | | |
|---|---|---|
| GB | 2472709 | 2/2011 |
| SU | 1198199 | 12/1985 |
| WO | 2002075097 | 9/2002 |
| WO | 2003/031766 A1 | 4/2003 |
| WO | 2009049006 | 4/2009 |

OTHER PUBLICATIONS

Search Report under Section 17 for GB Patent Application No. 1314323.5; dated Feb. 6, 2014; p. 1.

Patent Examination Report No. 1 in counterpart Australian Appl. 2014304322, dated May 10, 2016.

* cited by examiner

TUBULAR STABBING GUIDE

FIELD OF THE INVENTION

This invention relates to tubular stabbing guides, as used, for example, in the oil and gas industry when making-up a tubular string. Aspects of the invention also relate to mud buckets, wipers and cutters.

BACKGROUND OF THE INVENTION

In the oil and gas industry, and in other industries where bores are drilled in the earth to access sub-surface regions, many operations require the assembly or disassembly of long strings of tubulars. For example, when drilling a bore, a drill bit will typically be mounted on the distal end of a drill string formed of many drill pipe sections or joints. Each drill pipe joint has a threaded male or pin connection on a leading end and a threaded female or box connection on a trailing end. The drill pipe sections tend to be stored, ready for deployment, in the form of stands, usually of two or three connected joints.

A drill string is made up by adding stands to the upper end of the existing string. While a stand is being added the drill string is supported and held in the rig floor with only a short length of pipe, the "stick-up", extending from the floor. A new stand is then lifted and manipulated to bring the pin connection on the lower end of the stand towards the box connection on the upper end of the stick up. As the pin and box are brought together it is conventional to locate a stabbing guide on the box. A typically stabbing guide is formed of two hinged segments of a tough plastics material. The open segments are placed around the stick-up and then closed to form a funnel at the top of the box. The funnel guides the pin into alignment with the box, protecting the end surfaces and threads from damage.

Conventional stabbing guides are manually located and manipulated on to and from the box. However, there is a move towards minimizing the requirement for manual operations on the drill floor, and indeed in some jurisdictions such manual operations are prohibited.

SUMMARY OF THE INVENTION

According to an aspect of the present invention there is provided a tubular stabbing guide comprising: a mounting frame for location on a drill floor; and a plurality of funnel-forming members mounted on the frame, the mounting frame operable, in use, to move the funnel-forming members from a retracted location spaced from a box connection of a tubular string extending from the drill floor to an active location surrounding the box connection, such that the members may form a funnel for guiding a pin connection into the box connection.

With the funnel-forming members in the retracted location the box connection, and the surrounding area, may be accessible for other operations associated with making up or breaking out tubulars.

The frame may be pivotable to move the funnel-forming members between the retracted location and the active location.

The frame may be configured for mounting on a rotary table or other rotating member, permitting the stabbing guide to be rotated relative to the drill floor.

The funnel-forming members may be movable from an open configuration, surrounding but spaced from the box connection, to a closed or clamping configuration, engaging the box connection.

The funnel-forming members may be mounted on clamp members which are translatable to move the funnel-forming members between the open and closed configurations. In one embodiment, two clamp members are provided, and two funnel-forming members may be mounted on each clamp member.

The funnel-forming members may be height-adjustable, to accommodate different box connection positions.

The stabbing guide may include sensors to detect the box connection position, for example the height of the box connection relative to the drill floor.

The funnel-forming members may be movable from the open position, surrounding but spaced from the box connection, to a part-closed position, in which portions of the funnel-forming members engage the box connection, and then to a fully-closed position in which portions of the funnel-forming members extend over the upper end of the box connection.

In the part-closed position the funnel-forming members may be axially movable relative to the box connection. A mechanical sensor may be provided on one or more of the funnel-forming members for detecting the presence of a part of the box connection, and thus identifying the appropriate relative axial positioning of the box connection and the funnel-forming members, before the funnel-forming members are moved to the fully-closed position.

The stabbing guide may include one or more actuators. The actuators may include one or more of piston and cylinder arrangements, or motors.

The stabbing guide may be fluid-actuated, and may include an arrangement of sequential valves, to facilitate automated operation.

The stabbing guide may be configured for use with any suitable tubular or tubular assembly, stand, or string. The stabbing guide may be configured for use with drill pipe. The stabbing guide may be configured for use with casing. The stabbing guide may be configured for use with premium connectors, connections, or the like.

The stabbing guide may be operatively associated with or connected to a turns counter for counting the amount of relative rotation between the tubulars, such as a number of turns used to couple the tubulars. The stabbing guide may comprise the turns counter. For example, the turns counter may be mounted on or in the mounting frame.

According to another aspect of the invention there is provided a method for coupling tubulars, the method comprising: reconfiguring a drill floor-mounted frame to translate a plurality of funnel-forming members mounted on the frame from a retracted location on the drill floor to an active location surrounding a box connection extending from the drill floor and defining a funnel for guiding a pin connection into the box connection.

The method may comprise pivoting the frame to move the funnel-forming members between the retracted location and the active location.

The method may comprise rotating the stabbing guide relative to the drill floor, and may comprise rotating the stabbing guide around an axis of the box connection.

The method may further comprising moving the funnel-forming members from an open configuration in which the members are surrounding but spaced from the box connection to a closed or clamping configuration, engaging the box connection.

The method may further comprise adjusting the height of the funnel-forming members, to accommodate different box connection positions.

The method may comprise detecting the box connection position.

The method may comprise moving the funnel-forming members from the open position, surrounding but spaced from the box connection, to a part-closed position in which portions of the funnel-forming members engage the box connection, and then to a fully-closed position in which portions of the funnel-forming member extend over the upper end of the box connection.

The method may comprise axially moving the funnel-forming members in the part-closed position relative to the box connection, and may further comprise detecting the presence of a part of the box connection, and thus identifying the appropriate relative axial positioning of the box connection and the funnel-forming members, and then moving the funnel-forming members to the fully-closed position.

The method may comprise actuating the elements of the frame or the funnel-forming members, and such actuation may be by fluid.

The method may comprise sequentially actuating elements of the stabbing guide.

The method may comprise coupling the tubulars by rotating the tubulars relative to each other. For example, the method may comprise actively rotating an upper tubular whilst gripping or holding a lower tubular stationary.

The method may comprise counting the amount of relative rotation between the tubulars, such as a number of turns. Measuring the amount of relative rotation between the tubulars may comprise measuring the amount of a single or one of the tubulars, such as where one of the tubulars is held or fixed against rotation and only one or a single tubular is rotated. The method may comprise counting the amount of relative rotation between the tubulars at or proximal to the drill-floor. The method may comprise counting the amount of relative rotation between the tubulars at or proximal the coupling between the tubulars, such as adjacent the box connection (e.g. directly above). The method may comprise counting the amount of relative rotation between the tubulars only at or proximal the coupling between the tubulars, such as adjacent the box connection (e.g. directly above).

The method may comprise counting the amount of relative rotation between the tubulars with a turns counter at least operatively connected to the drill floor-mounted frame. The method may comprise counting the amount of rotation between the tubulars with a turns counter provided on or with the drill floor-mounted frame.

Although reference is made primarily to stabbing guides, other aspects of the invention may be utilized in the provision of a mud bucket, wiper or cutter. In such aspects the funnel-forming members could be replaced by a bucket or cup-forming members, wiping members or cutting members.

It should be understood that the features defined above in accordance with any aspect of the present invention or below in relation to any specific embodiment of the invention may be utilized, either alone or in combination with any other defined feature, in any other aspect or embodiment of the invention.

BRIEF DESCRIPTION OF THE DRAWINGS

These and other aspects of the present invention will now be described, by way of example, with reference to the accompanying drawings, in which.

DETAILED DESCRIPTION OF THE DRAWINGS

The figures illustrate a tubular stabbing or stab-in guide 10 in accordance with an embodiment of the present invention. As will be described, the stabbing guide 10 is used to assist the location of a pin end connection of a drill pipe joint or stand in a box end connection 14 which forms the upper end of a drill string, which string is held and supported from the drill floor 16 of a rig with a short section of the drill section, including the box connection, and commonly known by those skilled in the art as the "stick-up" 18, extending upwards of the rotary table 20.

Figure 1:
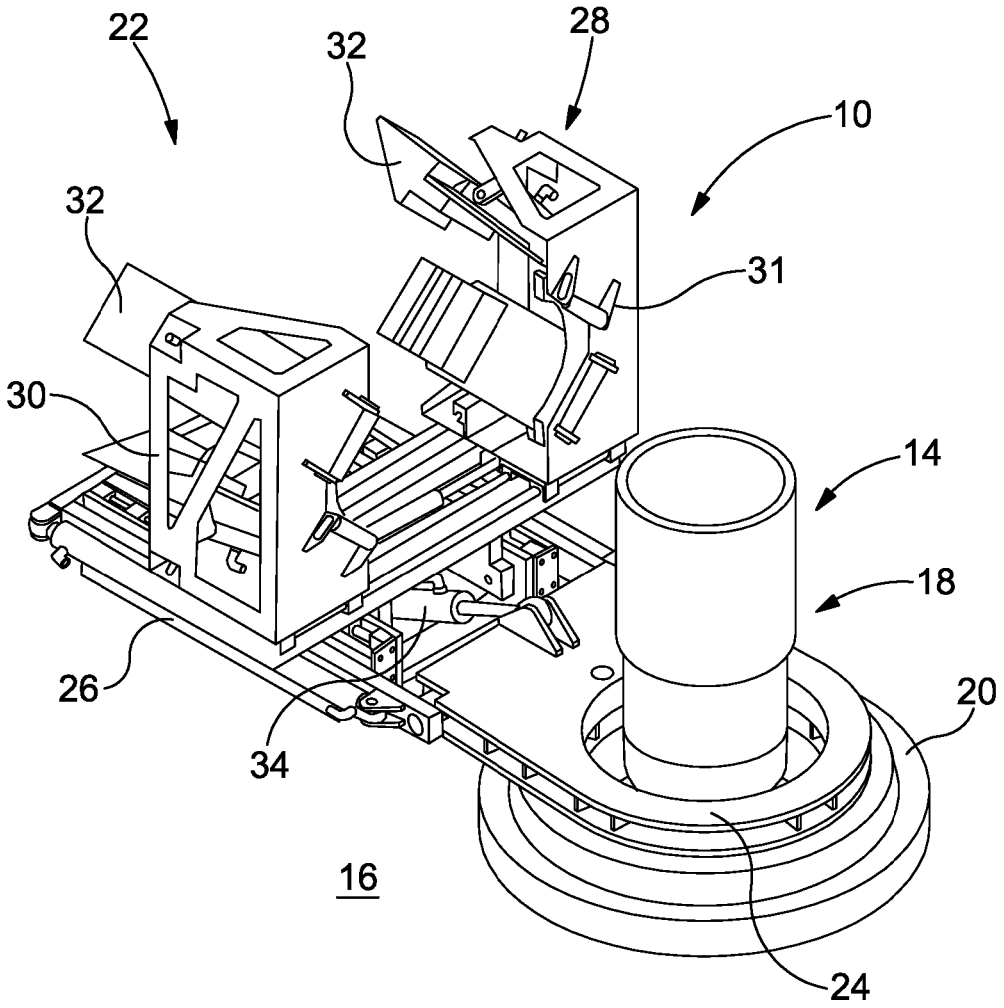
FIG. 1 is a front perspective view of a stabbing guide in accordance with an embodiment of the present invention, the stabbing guide being illustrated in a retracted configuration.
Figure 5:
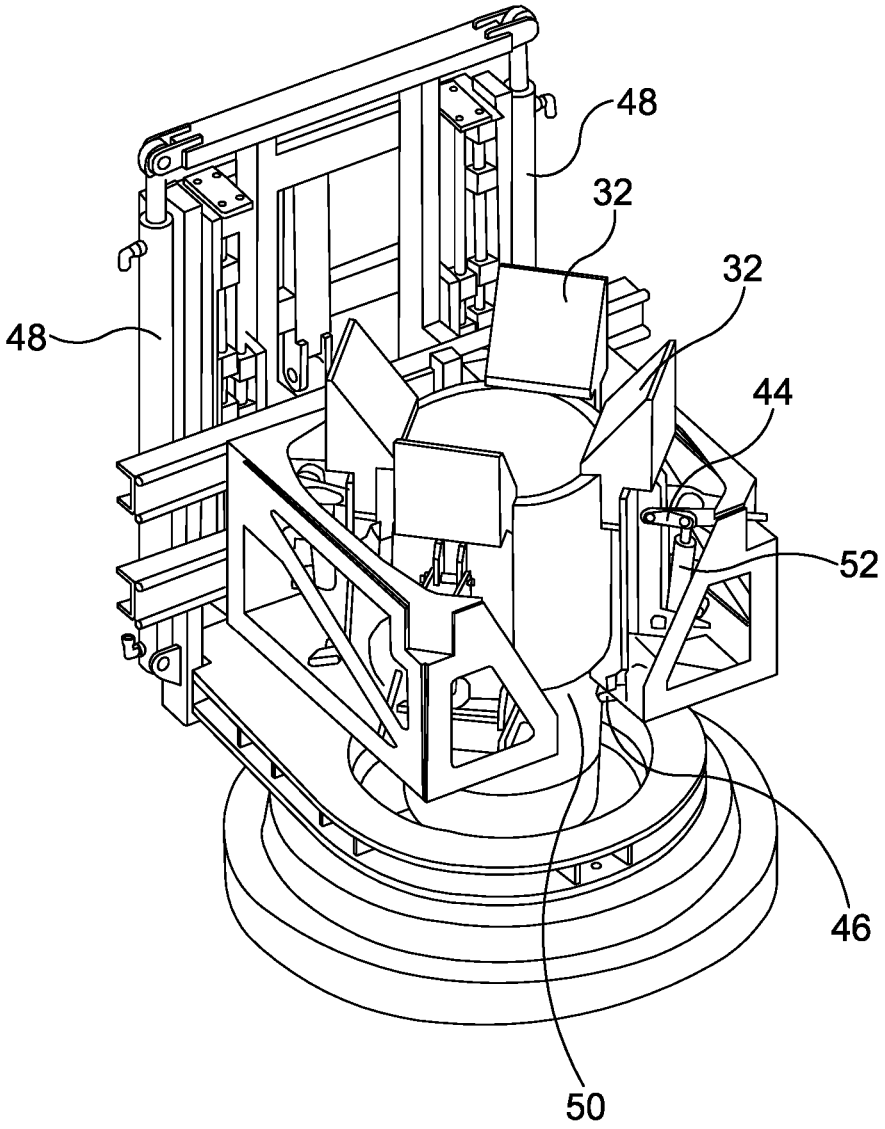
FIG. 5 shows the stabbing guide of FIG. 4 with the funnel-forming members in a fully-closed configuration.
Figure 6:
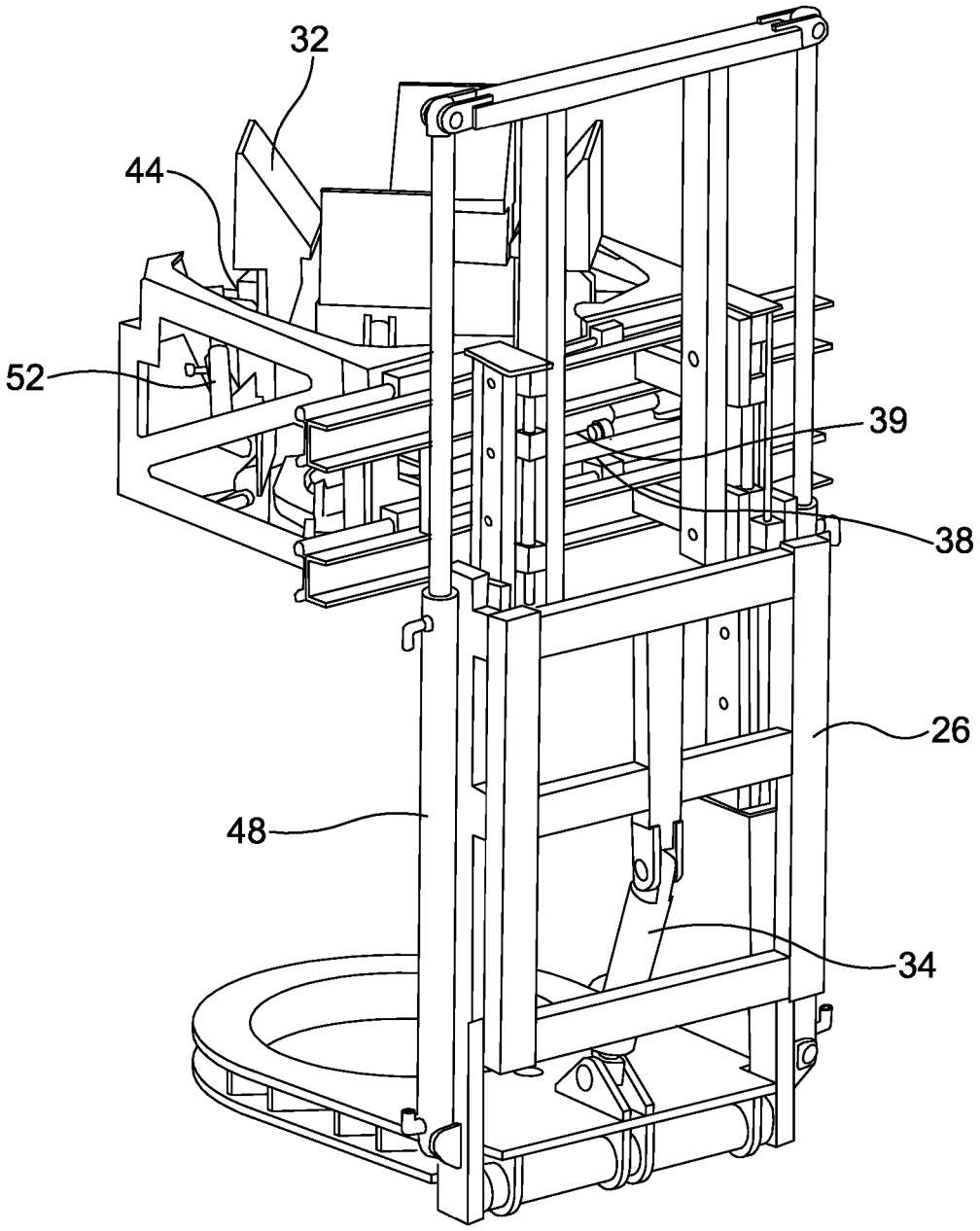
FIG. 6 is a rear perspective view the stabbing guide of FIG. 5, in a raised configuration.

The figures illustrate the sequence of operation of the guide 10, from an initial retracted configuration, as illustrated in FIG. 1, to a fully closed position, as illustrated in FIG. 5.

The guide includes a frame assembly 22 including a number of principal components, these being a baseplate 24 which is bolted to the rotary table 20, a telescopic tilt frame 26 which is pivotably attached to the baseplate 24, a clamping assembly 28 including left and right clamp structures 30, 31, each clamp structure 30, 31 carrying two tilt arm assemblies which include funnel-forming members 32 formed of a tough plastics material.

The stabbing guide 10 is hydraulically actuated and, as will be described, includes a number of hydraulic piston and cylinder arrangements. However, in the interest of clarity, the hydraulic control lines used to link the cylinders and the associated values, manifolds, the control assembly and the like have been omitted from all but FIGS. 7A and 7B.

As noted above, the baseplate 24 is bolted to the rotary table, such that the guide 10 may be rotatably positioned on the drill floor 16 simply by movement of the rotary table 20. While this arrangement may be appropriate when the drill string is being driven by a top drive, in other configurations in which the rotary table 20 is being used to drive the drill string an alternative mounting arrangement for the guide 10 may be employed.

Figure 2:
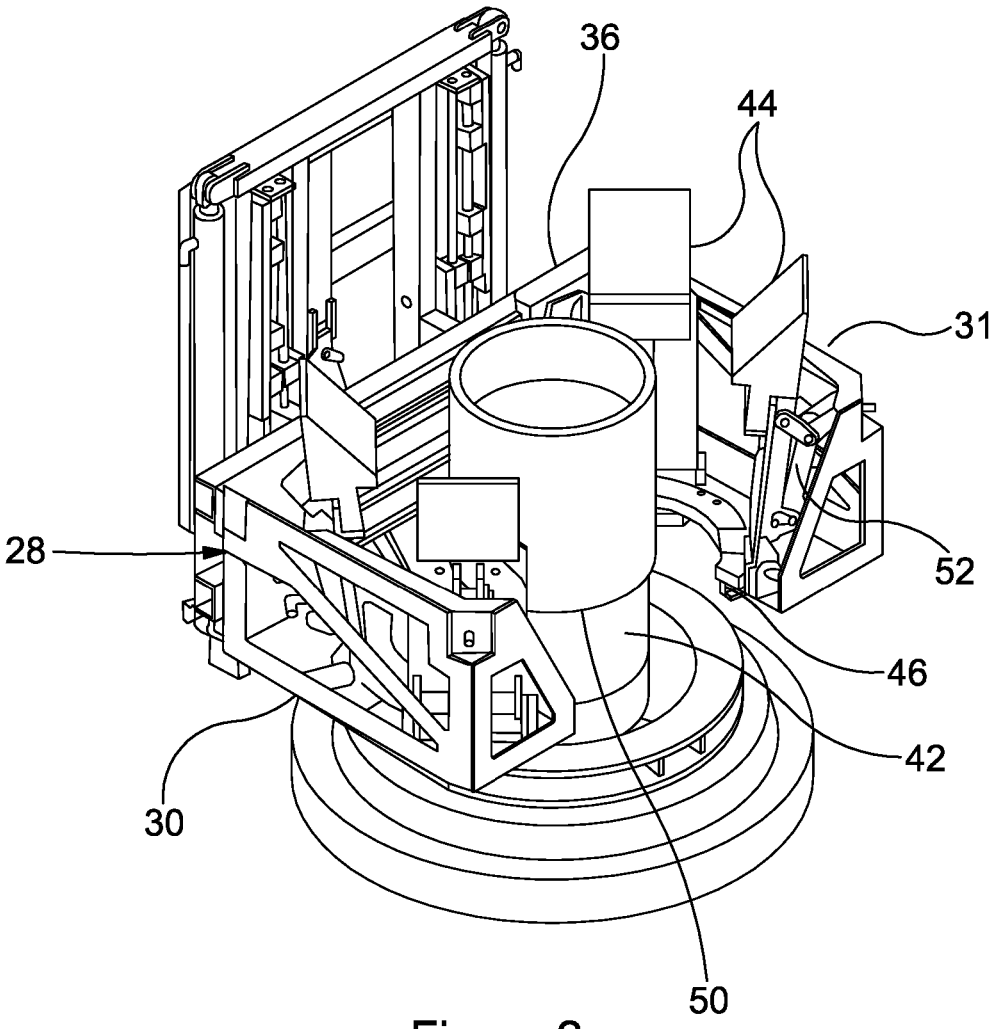
FIG. 2 shows the stabbing guide of FIG. 1 in an active configuration.

The tilt frame 26 is pivotably mounted to the baseplate 24. The movement of the tilt frame 26 from the retracted configuration as illustrated in FIG. 1, to the active configuration, as illustrated in FIG. 2, is controlled by a double-acting tilt cylinder 34. In the retracted configuration most of the structure of the stabbing guide 10 is spaced from the stick-up 18, so as not to obstruct access to the stick-up 18 for other apparatus.

Figure 3:
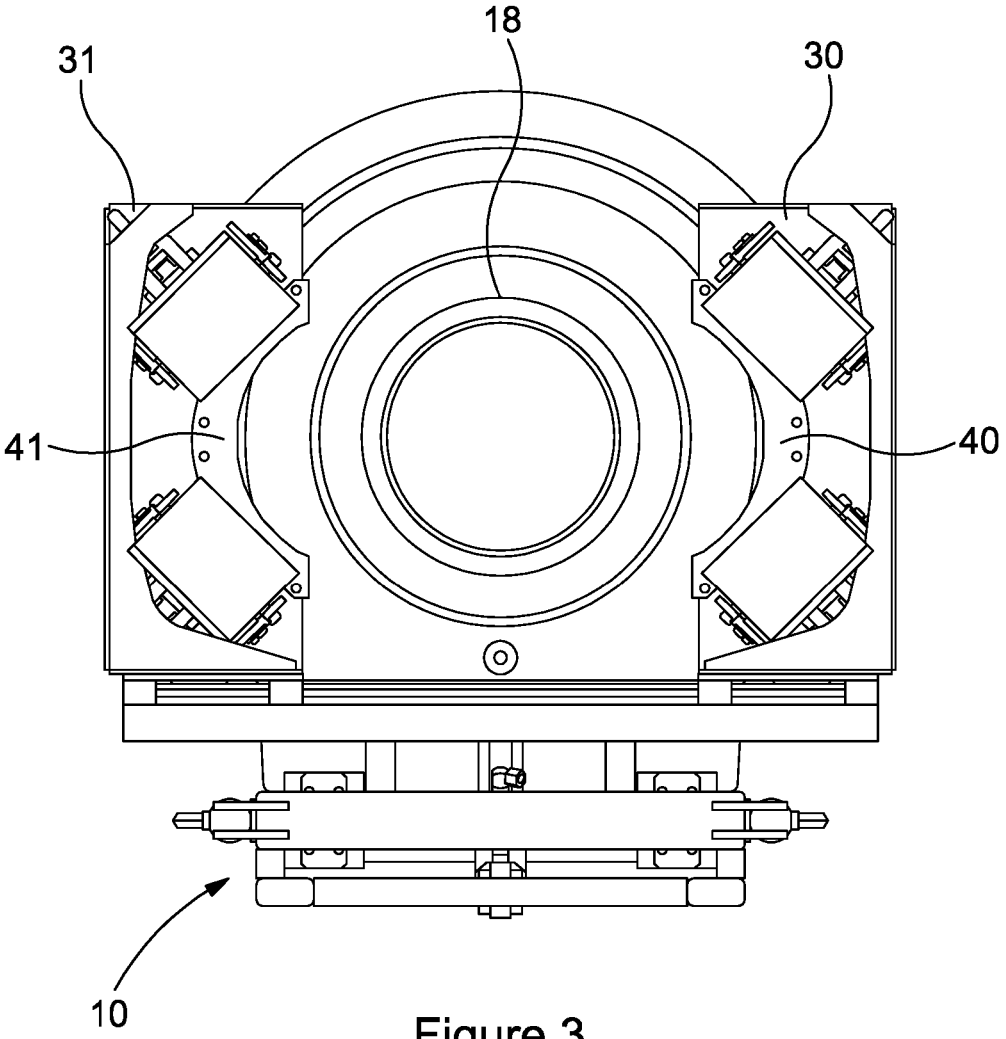
FIG. 3 is a plan view of the stabbing guide of FIG. 2.

When pivoting between the retracted and active configurations, the clamp structures 30, 31 of the clamping assembly 28 are located at the respective ends of a clamp support frame 36. Each clamp structure 30, 31 is associated with a respective clamp cylinder 38, 39. As may be seen more clearly in FIG. 3, with the clamp structures 30, 31 in the open configuration, the structures 30, 31 are clear of the stick-up 18, permitting unobstructed movement of the guide 10 between the retracted and active configurations.

Each clamp structure 30, 31 carries an annular plate segments 40, 41 having an inner face dimensioned to conform with the smaller diameter outer surface of the drill pipe below the box connection, labeled 42 in the figures. Each clamp structure 30, 31 also provides mounting for two tilt arm assemblies 44, the upper ends of which carry the funnel-forming members 32.

Figure 4:
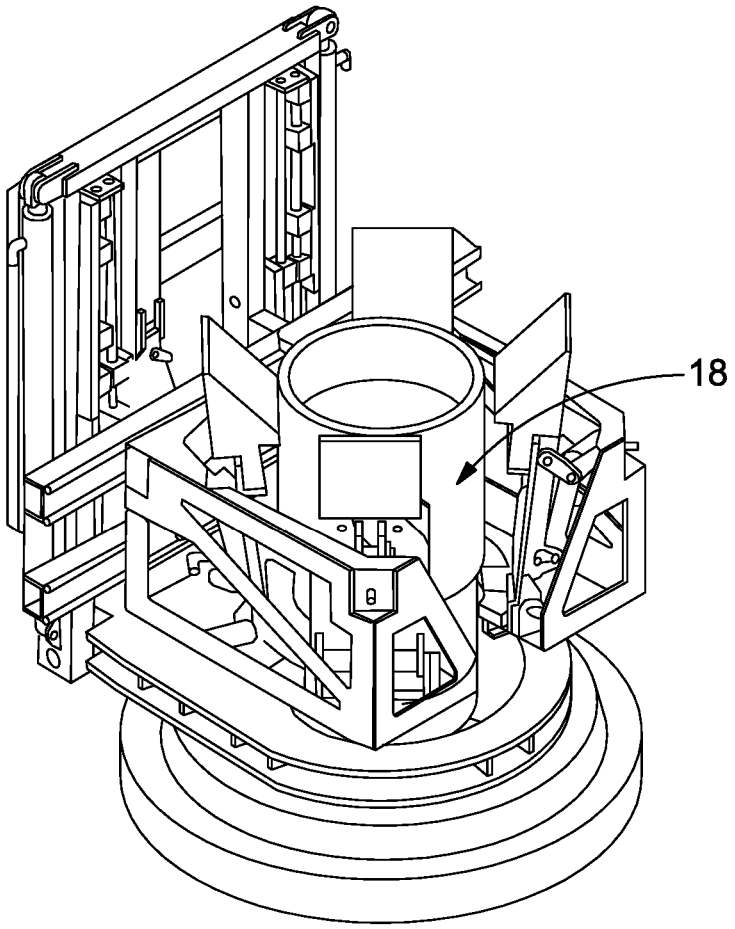
FIG. 4 shows the stabbing guide of FIG. 2 with funnel-forming members in a part-closed configuration.

Once the stabbing guide 10 has been moved to the active configuration, the clamp cylinders 38, 39 may be actuated to move the clamping structures 30, 31 into initial engagement with the stick-up 18, as illustrated in FIG. 4. In addition to bringing the segments 40, 41 into close proximity to the smaller diameter portion of the drill pipe 42, four rollers 46 located below each tilt arm assembly are also brought into contact with the pipe 42. When this initial contact is achieved, the tilt arm assemblies 44 are tilted outwards, to space the funnel-forming members 32 from the upper end of the box 14. One reason for this is that the length of the stick-up 18 extending above the rotary table 20 will vary and cannot be precisely predicted. Accordingly, after making the initial engagement, cylinders 48 on the tilt frame 26 are actuated to telescopically extend the frame 26, and lift the tilt arm assemblies 44 up the box connection 14. This continues until the segments 40, 41 come into contact with the step 50 formed between the pipe body 42 and the box 14, which contact is detected by a sensor provided below one of the tilt arm assemblies 44, and which halts further upward movement. At this point, four small hydraulic cylinders 52 associated with each tilt arm assembly 44 are extended to move the funnel-forming members 32 radially inwards and over the upper end of the box connection 14 to the position as illustrated in FIG. 5. The members 32 thus collectively form a funnel that will guide a pin connection being lowered into the box connection 14 into the center of the box connection 14, and will also protect the upper end of the box 14 and the lower end of the pin from damaging one another.

Figure 7B:
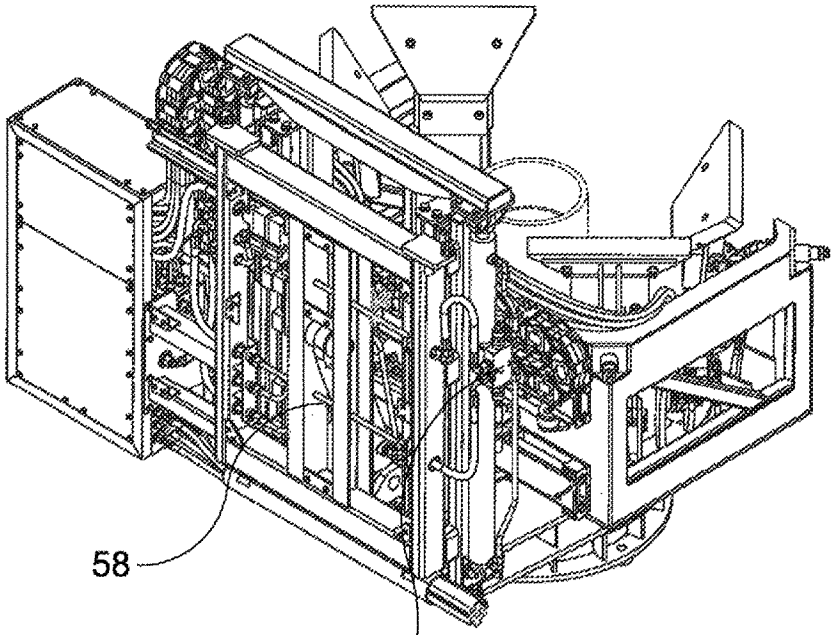
FIG. 7B is a rear perspective view of the stabbing guide of FIG. 2.
Figure 7A:
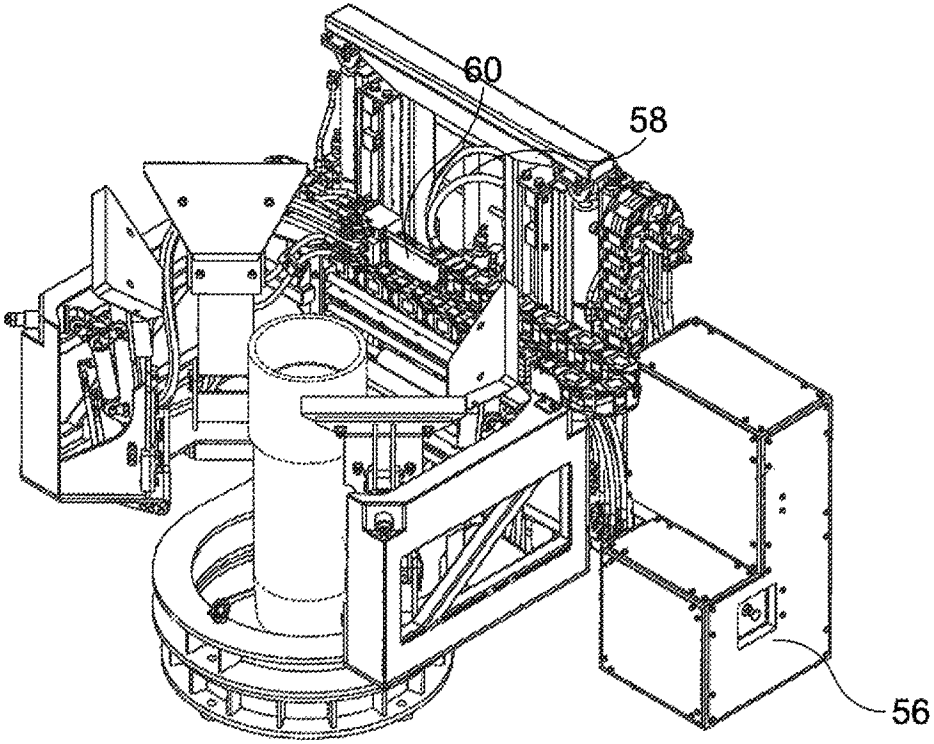
FIG. 7A is a front perspective view of the stabbing guide of FIG. 2, and showing the hydraulic circuitry.

Operation of the guide 10 is controlled by a number of sequence valves located within the control assembly 56, as shown in FIGS. 7A and 7B. The valves control flow of actuating hydraulic fluid from an appropriate source through appropriate hydraulic lines 58, manifolds 60 and the various actuating cylinders. Thus, operation of the stabbing guide 10 is relatively simple and automated.

It will be apparent to those skilled in the art that the above described embodiment is merely exemplary of the present invention and that various modifications and improvements may be made thereto without departing from the scope of the present invention. For example, a somewhat similar structure may be employed to provide an automated and mechanized mud bucket for capturing and guiding fluid draining from a drill pipe stand being disconnected from a drill string during a tripping operation. In such an apparatus the funnel-forming members would be replaced by segments which, when the tilt arm assemblies were extended inwards, formed a cup or bucket around the box 14 such that any fluid draining from a connection that had just been broken would flow into the bucket, and from the bucket would be guided to an appropriate storage or treatment facility.

Alternatively, rather than funnel-forming members, the tilt arms could be provided with suitable wiping blades or brushes, such that fluid or other material on the exterior of a string being pulled up through the apparatus would be wiped off the surface of the string and collected for storage or treatment.

In a somewhat similar manner, the tilt arm assemblies could be provided with cutting structures which could be extended to engage a tubular extending through the apparatus. Cutting could be effected, for example, by rotation of the tubular within the stationary apparatus, or by use of the rotary table to rotate the apparatus relative to the tubular.

The above description primarily refers to use of the apparatus with drill pipe. However, the apparatus may equally be used with other tubulars, for example, in the making up of a casing string, in which case the box connection as described above may be replaced by a threaded collar or the like, and/or with premium type connections, tubing and casing for example but not exclusively from 2 ⅞ inch (73 mm) to 20 inch (508 mm) diameter.

It will also be appreciated that in other embodiments, the stabbing guide may be operatively associated with or connected to a turns counter for counting the amount of relative rotation between the tubulars, such as a number of turns used to couple the tubulars. In some embodiments, the stabbing guide comprises the turns counter, such as mounted on or in the mounting frame.

Providing a turns counter with the stabbing guide may allow the relative rotation between the tubulars (e.g. the number of turns of at least one of the tubulars) to be counted at or proximal to the connection point between the tubulars, such as at or directly adjacent the box connection (e.g. directly above the box connection). Accordingly, the turns counter may provide an accurate or more accurate reading of the actual amount of relative rotation or number of turns, such as when compared to measuring with a turns counter located more distal to the connection, such as a turns counter measuring the rotation of a tubular at or adjacent where the a running tool latches onto the tubular. For example, where a running tool latches onto a tubular 40 feet above the drill-floor or box connection to be connected, there may be up to 40 feet of tubular to be connected between the turns counter and the point of connection. Accordingly, differences between the amount of rotation between the latching-on point and the actual connection may not be measurable or accurately measurable with such a turns counter located above the drill-floor. For example, any deflections of the tubular to be connected may detract from the accuracy of the number of turns measured by the turns counter at or adjacent the actual connection.

The invention claimed is:

1. A tubular stabbing guide for a tubular string having a box connection and a pin connection, the tubular stabbing guide comprising:

a mounting frame for location on a drill floor;

a plurality of funnel-forming members mounted on the mounting frame, the mounting frame operable, in use, to move the funnel-forming members from a retracted location on the drill floor and spaced from the box connection of the tubular string extending from the drill floor to an active location surrounding the box connection, such that the funnel-forming members may form a funnel for guiding the pin connection into the box connection, wherein the mounting frame is pivotable to move the funnel-forming members between the retracted location and the active location; and a mounting arrangement onto which the mounting frame is mounted, wherein the mounting frame is pivotably attached to and pivotable relative to the mounting arrangement to permit the pivotable movement of the funnel-forming members between the retracted location and the active location, and wherein the mounting arrangement is mounted for rotation relative to the drill floor, the mounting arrangement thus being rotatable around the box connection to permit the tubular stabbing guide to be rotatably positioned relative to the box connection.

2. The tubular stabbing guide of claim 1, wherein the mounting frame is pivotable around a horizontal axis to move the funnel-forming members between the retracted location and the active location.

3. The tubular stabbing guide of claim 1, wherein the mounting frame is configured for mounting on a rotary table of the drill floor to permit the tubular stabbing guide to be rotated relative to the drill floor.

4. The tubular stabbing guide of claim 1, wherein the funnel-forming members are movable from an open configuration to a closed configuration.

5. The tubular stabbing guide of claim 4, wherein at least one of:

the funnel-forming members surround and are spaced from the box connection when in the open configuration;

the funnel-forming members engage the box connection when in the closed configuration; and the funnel-forming members are mounted on clamp members which are translatable to move the funnel-forming members between the open configuration and the closed configuration.

6. The tubular stabbing guide of claim 4, wherein the funnel-forming members are movable from the open configuration to a part-closed position and then to a fully-closed position defining said closed configuration in which portions of the funnel-forming members extend over an upper end of the box connection.

7. The tubular stabbing guide of claim 6, wherein at least one of:

portions of the funnel-forming members engage the box connection when the funnel-forming members are in the part-closed position; and the funnel-forming members are axially movable relative to the box connection when the funnel-forming members are in the part-closed position.

8. The tubular stabbing guide of claim 1, wherein the funnel-forming members are height-adjustable.

9. The tubular stabbing guide of claim 1, including one or more actuators.

10. The tubular stabbing guide of claim 1, wherein the tubular stabbing guide is fluid-actuated.

11. A method for coupling tubulars having box and pin connections, the method comprising:

reconfiguring a drill floor-mounted frame of a stabbing guide to translate a plurality of funnel-forming members mounted on the drill floor-mounted frame from a retracted location on the drill floor to an active location surrounding the box connection extending from the drill floor and defining a funnel for guiding the pin connection into the box connection, wherein the drill floor-mounted frame is mounted on a mounting arrangement, wherein the mounting frame is pivotably attached to and pivotable relative to the mounting arrangement, wherein reconfiguring the drill floor-mounted frame comprises:

pivoting the drill floor-mounted frame relative to the mounting arrangement to move the funnel-forming members between the retracted location and the active location; and wherein said mounting arrangement is mounted for rotation relative to the drill floor, the mounting arrangement thus being rotatable around the box connection to permit the stabbing guide to be rotatably positioned relative to the box connection.

12. The method of claim 11, comprising pivoting the drill floor-mounted frame about a horizontal axis to move the funnel-forming members between the retracted location and the active location.

13. The method of claim 11, comprising rotating the stabbing guide relative to the drill floor.

14. The method of claim 11, further comprising moving the funnel-forming members from an open configuration to a closed configuration.

15. The method of claim 14, wherein at least one of:

the funnel-forming members surround and are spaced from the box connection when in the open configuration; and the funnel-forming members engage the box connection when in the closed configuration.

16. The method of claim 11, further comprising adjusting the height of the funnel-forming members.

17. The method of claim 11, comprising detecting the box connection position.

18. The method of claim 11, comprising moving the funnel-forming members from the open configuration to a part-closed position and then to a fully-closed position defining said closed configuration, in which fully-closed position portions of the funnel-forming member extend over the upper end of the box connection.

19. The method of claim 18, wherein at least one of:

engaging portions of the funnel-forming members engage with the box connection when the funnel-forming members are in the part-closed position; and axially moving the funnel-forming members in the part-closed position relative to the box connection.

20. The method of claim 18, further comprising detecting the presence of a part of the box connection and then moving the funnel-forming members to the fully-closed position.

21. The method of claim 18, further comprising detecting the presence of a part of the box connection to identify the appropriate relative axial positioning of the box connection and the funnel-forming members.

* * * * *